US006519888B1

(12) United States Patent
Oberst

(10) Patent No.: US 6,519,888 B1
(45) Date of Patent: Feb. 18, 2003

(54) LOCKABLE FIREARM SAFETY

(75) Inventor: E. Ernest Oberst, Cheshire, CT (US)

(73) Assignee: The Marlin Firearms Company, North Haven, CT (US)

( * ) Notice: Subject to any disclaimer, the term of this patent is extended or adjusted under 35 U.S.C. 154(b) by 0 days.

(21) Appl. No.: 09/603,039

(22) Filed: Jun. 26, 2000

(51) Int. Cl.[7] ..... F41A 17/00
(52) U.S. Cl. ..... 42/70.11; 42/70.06
(58) Field of Search ..... 42/70.11, 70.07, 42/70.06

(56) References Cited

U.S. PATENT DOCUMENTS 3,735,519 A * 5/1973 Fox ..... 42/70
4,014,123 A * 3/1977 Williams ..... 42/1
5,535,605 A * 7/1996 Werner ..... 70/14
5,743,039 A * 4/1998 Garrett ..... 42/70.11
5,832,647 A * 11/1998 Ling et al. ..... 42/70.07
5,930,930 A * 8/1999 Howell ..... 42/70.11
5,946,841 A * 9/1999 Roper ..... 42/70.11
6,125,568 A * 10/2000 Granaroli ..... 42/70.11
6,141,896 A * 11/2000 Oberst ..... 42/70.06

* cited by examiner

*Primary Examiner*—Michael J. Carone
*Assistant Examiner*—M Thomson
(74) *Attorney, Agent, or Firm*—Alix, Yale & Ristas, LLP

(57) ABSTRACT

A lockable firearm safety comprising a cross bolt mechanism cooperating with rotatable combination dials. The cross bolt safety is axially displaceable between safe and fire positions. The firearm safety is mounted substantially within a recess defined in the firearm receiver or trigger guard. Each dial includes an internal raceway, an inner face and a connecting recess defined within one side. The cross bolt includes radially projecting shoulders. Each radially projecting shoulder cooperates with a respective inner face to generally prevent movement of the cross bolt from the safe position to the fire position. Each radially projecting shoulder cooperates with a respective connecting recess at a single rotational position of the combination dial to allow axial movement of the cross bolt from the safe position to the fire position. The cross bolt prevents discharge of the firearm in the safe position and allows discharge of the firearm in the fire position.

13 Claims, 6 Drawing Sheets

LOCKABLE FIREARM SAFETY

BACKGROUND OF THE INVENTION

This invention relates generally to safety mechanisms employed in firearms to prevent discharge of the firearm. More particularly, this invention relates to safety mechanisms that are lockable to prevent discharge of the firearm by unauthorized users.

Safeties for firearms are commonplace with numerous types of safety mechanisms known. One general type of safety mechanism involves a cross bolt oriented generally transversely to the longitudinal axis of the firearm. The safety mechanism is operated by manually displacing the cross bolt between axially spaced safe and fire positions. When the cross bolt is in the fire position, a user actuating the trigger may readily discharge the firearm. When the cross bolt is in the safe position, discharge of the firearm is prevented. The cross bolt safety mechanism may be semi-stably retained in one of these positions by a spring-biased detent or other means. There typically is no provision for locking the cross bolt in the safe position to prevent movement therefrom by unauthorized persons.

The cross bolt safety prevents discharge of the firearm by selectively interfering with a component of the firing mechanism. The cross bolt safety may function as a hammer blocking mechanism. In this configuration, a component of the cross bolt safety is configured as a hammer block to selectively interfere with the hammer and/or a component in the hammer assembly. In the cross bolt safe position, the hammer block prevents the hammer from moving sufficiently to engage the firing pin and discharging the firearm. When the cross bolt is moved to the fire position, the hammer is free to strike the firing pin and discharge the firearm.

The cross bolt safety may alternatively function as a trigger blocking mechanism. In this configuration, a component of the cross bolt safety is configured as a trigger block to selectively interfere with the trigger and/or a component in the trigger assembly. In the cross bolt safe position, the trigger block prevents the trigger from moving sufficiently to discharge the firearm. When the cross bolt is moved to the fire position, actuation of the trigger to discharge the firearm is possible.

The use of locks and locking mechanisms, including electronic devices, to prevent discharge of a firearm by unauthorized persons is also commonplace and a wide variety of devices and techniques have been advanced. The majority of conventional firearm locks and locking mechanisms operate independently of the firearm safety mechanism.

SUMMARY OF THE INVENTION

Briefly stated, the invention in a preferred form is a lockable firearm safety that incorporates a plurality of combination dials with a cross bolt safety mechanism. Each combination dial comprises spaced first and second sides and defines a central through bore connecting the sides. A circular raceway is defined within one side of each dial terminating at an inner face. A connecting recess extends transversely from the inner face toward the opposing side and radially connects with the dial through bore. The dial outer diameter includes indicia such as numerical markings disposed around the circumference. The cross bolt is mounted in the dial through bores generally transversely of the firearm longitudinal axis for axially displacement between the safe and the fire position. A plurality of pins project from the cross bolt. The pins may be mounted to the cross bolt for biased radial displacement. Each pin cooperates with the inner face of a respective dial to lock the cross bolt in the safe position. When each connecting recess is rotationally aligned with its respective pin, the cross bolt may be manually displaced from the safe position to the fire position. The combination dials and cross bolt are mounted within a recess in the firearm. Typically the recess will be in the receiver or trigger guard.

The cross bolt has axially spaced first and second surfaces that are respectively configured to prevent the discharge of the firearm in the safe position while allowing the firearm to discharge in the fire position. The cross bolt is preferably configured with first and second axially spaced recesses to retain the cross bolt in a semi-stable relationship in the safe and fire positions. An outer surface of the cross bolt may be fixed with an indicator to indicate when the cross bolt is positioned in the fire or safe position.

In one embodiment, the cross bolt is engageable with the trigger assembly to block the trigger from discharging the firearm when the cross bolt is in the safe position. In a second embodiment, the cross bolt is engageable with the hammer assembly to block the hammer from discharging the firearm when the cross bolt is in the safe position. In another embodiment the cross bolt is engageable with a striker assembly to block a striker from discharging the firearm when the cross bolt is in the safe position.

An object of the invention is to provide a new and improved lockable safety for a firearm.

Another object of the invention is to provide a new and improved lockable firearm safety that is reliable and provides a high degree of security for a firearm.

A further object of the invention is to provide a new and improved lockable firearm safety having an efficient and low cost construction and which can be readily incorporated into a firearm without substantial modification thereof.

A yet further object of the invention is to provide a new and improved locking device firearm which is operatively coupled in a user friendly application in conjunction with a proven safety for a firearm.

BRIEF DESCRIPTION OF THE DRAWINGS

Other objects and advantages of the invention will become apparent from the specification and the drawings in which.

DETAILED DESCRIPTION OF THE PREFERRED EMBODIMENT

Figure 1:
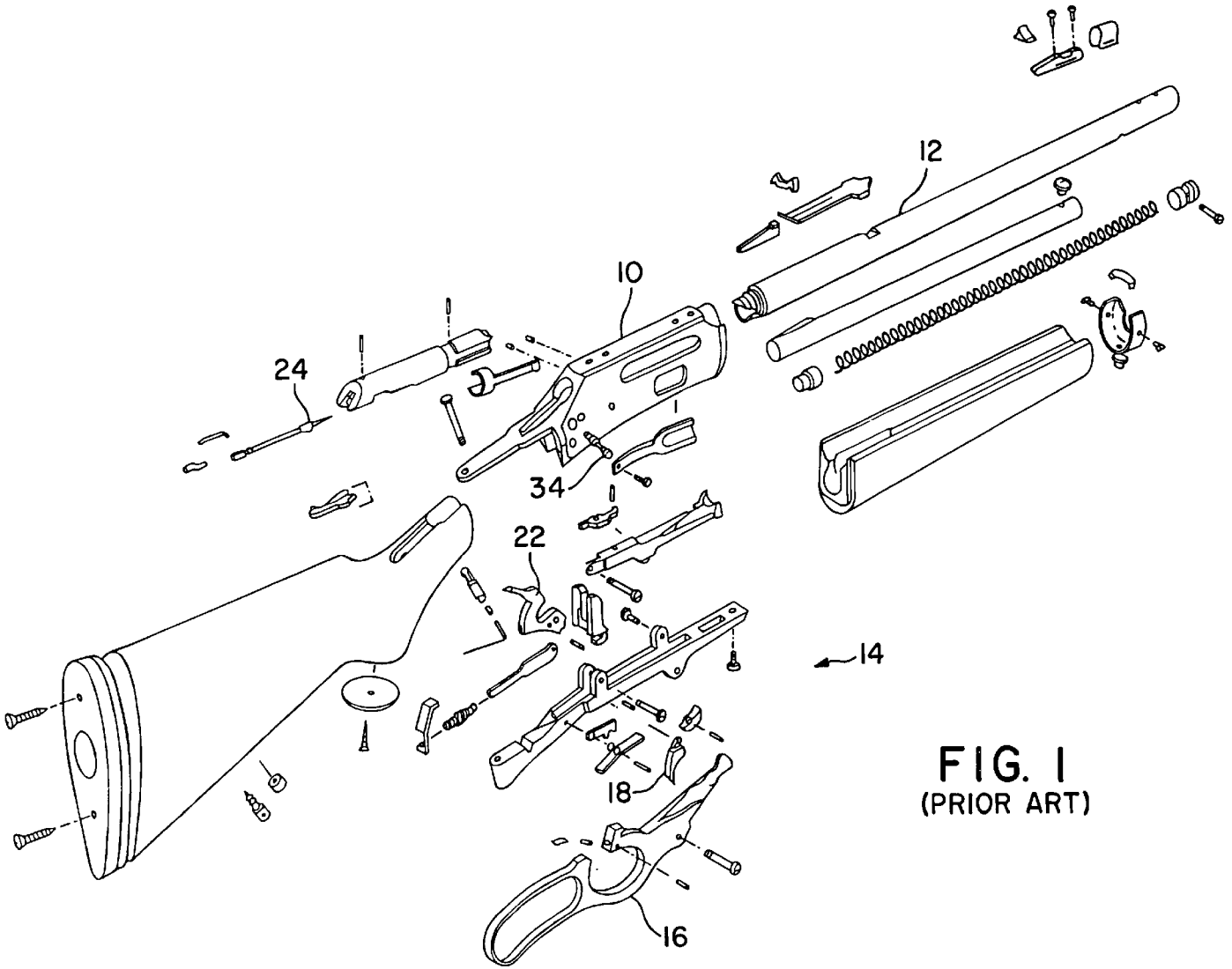
FIG. 1 (PRIOR ART)
FIG. 1 is an exploded view, in perspective, of a conventional firearm.

With reference to the drawings wherein like numerals represent like parts throughout the several figures, as shown in FIG. 1 a firearm typically comprises a receiver or frame 10 to which a barrel 12 is mounted in well-known fashion. The receiver 10 defines a firearm longitudinal axis that is generally parallel to the barrel 12. A trigger guard assembly 14 includes a trigger guard 16 for a trigger 18. The trigger guard assembly 14 is mounted to the underside of the receiver 10 in line with the firearm longitudinal axis. The trigger 18 is pivotally mounted to the receiver 10 or trigger guard 16 and substantially disposed within the trigger guard 16. The trigger 18 is pulled rearward in a conventional fashion to actuate the firing mechanism and discharge the firearm.

The firing mechanism may employ a spring-biased pivoting hammer 22 that cooperates with a firing pin 24, a striker assembly (not shown), or other well-known firing mechanisms. For simplicity the invention will be described in relation to a firing mechanism using a hammer 22 and firing pin 24. It should be understood that the invention could be advantageously used with other firing mechanisms such as, for instance, those employing strikers. Actuation of the trigger 18 functions to release the hammer 22 to strike the firing pin 24 and propel the firing pin into contact with the primer of a cartridge housed in a chamber. Contact of the pin with the primer generates sufficient energy to explode a primer mixture and ignite a propellant within the cartridge. Combustion of the propellant generates sufficient pressure to discharge a bullet from the barrel 12.

Figure 2:
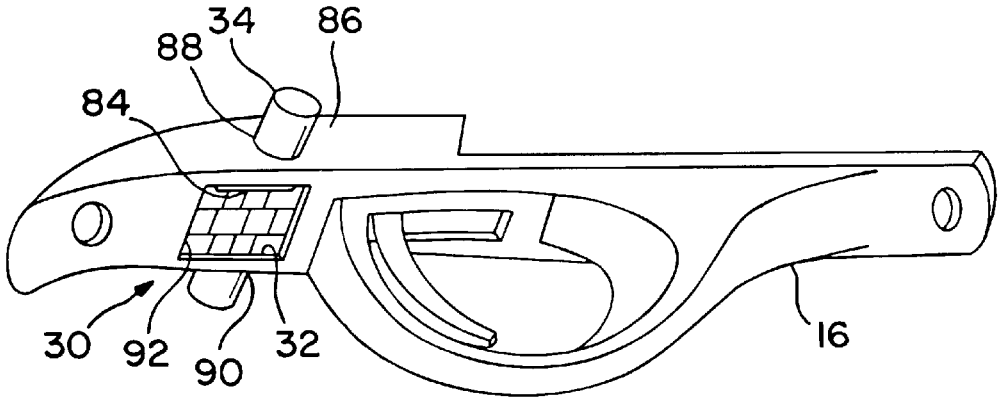
FIG. 2 is a perspective view of a trigger guard assembly incorporating an embodiment of the inventive cross bolt safety.

With reference to FIG. 2, a lockable firearm safety in accordance with the present invention is generally designated by the numeral 30. The lockable firearm safety 30 employs a plurality of spaced combination dials (each 32) that cooperate with the cross bolt 34 for transforming the firearm between a locked safe position, an unlocked safe position and an unlocked fire position. In the locked safe position, the cross bolt 34 cannot be axially moved from the safe position until each of the combination dials 32 is first placed in a predetermined rotational position. In either of the unlocked positions, the cross bolt 34 is readily axially displaced by pressure of a user's fingers on the cross bolt end. The safety 30 may assume a wide variety of forms and is configured to be readily incorporated into conventional firearms to provide a trigger block-type safety or a hammer block-type safety.

Figure 3:
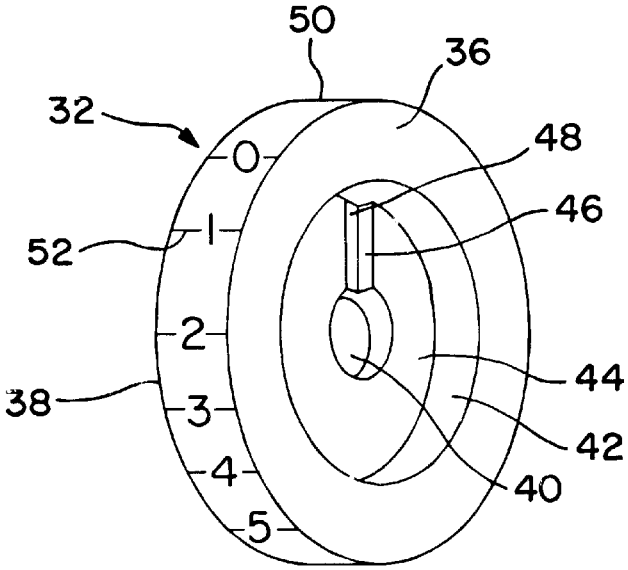
FIG. 3 is a perspective view of an embodiment of a combination dial of the invention.

As shown in FIG. 3, each dial comprises spaced first 36 and second 38 sides and defines a central through bore 40 connecting the sides 36, 38. A circular recess or raceway 42 is defined within one side of each dial 32. The raceway 42 extends from a first dial side 36 transversely toward the second dial side 38, terminating at an inner face 44. A connecting recess 46 extends transversely from the inner face 44 toward the dial second side 38. Preferably, the connecting recess 46 does not penetrate through the dial second side 38, but instead terminates at a shoulder 48. The connecting recess 46 radially connects with the dial through bore 40. The dial 32 includes indicia 52 such as numerical markings disposed around the outer circumference 50.

Figure 4:
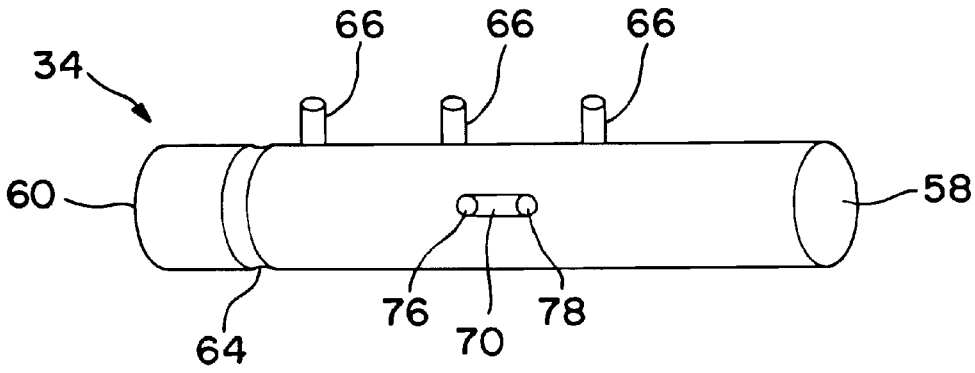
FIG. 4 is perspective view of one embodiment of a cross bolt of the invention.

As shown in FIG. 4, the cross bolt 34 is an elongated, typically cylindrical member having opposed safe and fire ends 58, 60 respectively. The ends 58, 60 may be adapted to facilitate transverse displacement of the cross bolt, such as by ribbing or checkering 62 (shown in FIG. 5). At least one end preferably includes indicia 64 such as colors, letters, grooves or other means to indicate when the cross bolt is in the fire position. A plurality of spaced pins, each 66, respective in number to the number of dials 32 used in the firearm safety 30, project from the cross bolt 34 intermediate the ends.

The cross bolt 34 includes an axially extending slot 70. A pin mounted to the firearm is engaged within the slot 70. The pin preferably intersects the cross bolt 34 in perpendicular relationship. Engagement of the pin within the slot 70 allows axial displacement of the cross bolt 34 from the safe position to the fire position and vice versa; however, it prevents rotational movement of the cross bolt 34.

Figure 5:
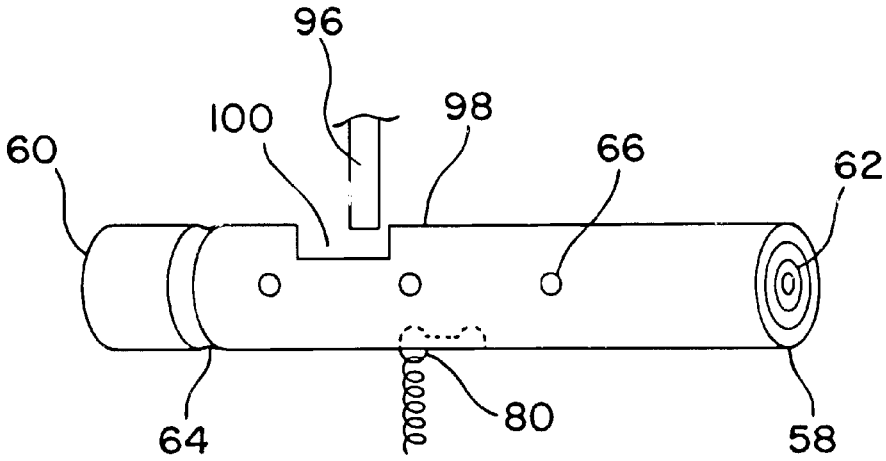
FIG. 5 is a top view, partly in phantom, of the cross bolt of FIG. 4.

Preferably as shown in FIGS. 4 and 5 the slot 70 includes axially spaced and rotationally aligned first 76 and second 78 recesses. A detent 80 is resiliently biased for projection into the first recess 76 when the cross bolt 34 is in the safe position and for projection into the second recess 78 when the cross bolt 34 is in the fire position. However, upon manual axial displacement of the cross bolt 34 between the safe and fire positions, the detent 80 is sufficiently resiliently biased and the defining walls between the recesses 76, 78 are contoured to permit the detent 80 to cam over the boundary between one recess to the opposing recess. In this manner the detent 80 and recesses 76, 78 provide a well-defined semi-stable safe and fire position for the cross bolt 34. The recesses 76, 78 may be provided on the cross bolt 34 away from slot 70.

Figure 6:
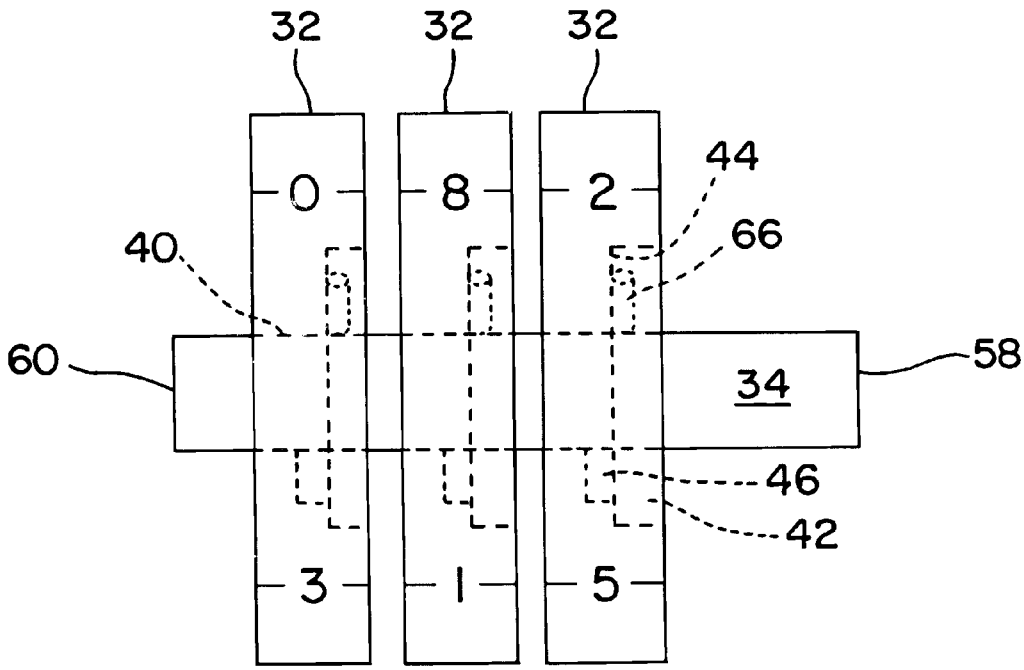
FIG. 6 is a bottom plan view, partly in phantom, of a cross bolt disposed within a plurality of combination dials in the safe position.

As shown in FIG. 6, the cross bolt 34 is disposed within each through bore 40 of the plurality of spaced dials 32. Each pin 66 is housed within a respective circular raceway 42. This corresponds to the safe position of the cross bolt 34. In this position, independent rotation of each of the combination dials 32 around the cross bolt 34 is possible. However, axial movement of the cross bolt 34 from the safe position to the fire position is prevented by interference of the cross bolt pin 66 with a respective dial inner face 44. The cross bolt 34 is mounted as later described so that only axial movement is permitted.

Figure 7:
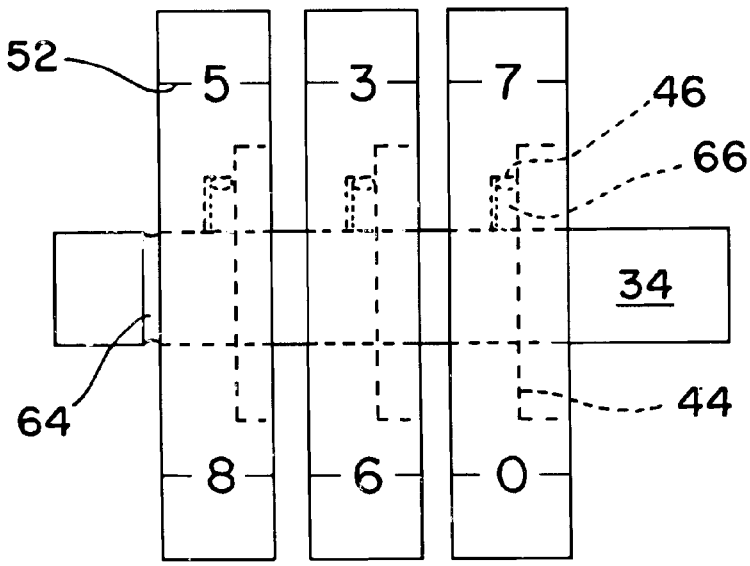
FIG. 7 is a bottom plan view, partly in phantom, of a cross bolt disposed within a plurality of combination dials in the fire position.

The combination dials 32 can be independently, manually rotated to align each connecting recess 46 with a respective cross bolt pin 66 as shown in FIG. 7. The connecting recess 46 provides room for housing the respective cross bolt pin 66. When each connecting recess 46 is rotationally aligned with its respective cross bolt pin 66, the cross bolt 34 may be axially displaced from the safe position to the fire position. In this condition, the combination dials 32 are rotationally fixed by contact of the cross bolt pin 66 with the connecting recess 46. Axial displacement of the cross bolt 34 from the fire position to the safe position clears the cross bolt pins 66 from their respective connecting recesses 46, allowing subsequent rotation of the combination dials 32, thereby locking the cross bolt 34 in the safe position. While the cross bolt pins 66 are shown as rotationally or angularly aligned, the pins may be angularly displaced with respect to each other with no effect on the locking function of the combination dial 32.

The plurality of dials 32 and cross bolt 34 are preferably mounted within a recess 84 in the trigger guard 16 as shown in FIG. 2. In some embodiments (not shown) the plurality of dials may be mounted within a recess in other parts of the firearm such as, for instance, in the receiver 10 or both receiver 10 and trigger guard 16. The recess 84 includes spaced sidewalls 86 each defining an aperture 88, 90, which are axially aligned with the dial through bores 40. The cross bolt 34 is mounted within the spaced apertures 88, 90. Preferably the cross bolt safe end 58 projects from one aperture 88 in the safe position and the cross bolt fire end 60 projects from the opposing aperture 90 in the fire position. Engagement of the detent 80 within the cross bolt slot 70 prevents removal of the cross bolt 34 from the recess 84 in a first direction while engagement of the cross bolt pins 66 with the dial inner faces 44, as well as engagement of the detent 80 with the opposing end 78 of the cross bolt slot 70, prevents removal of the cross bolt from the opposing aperture 90. The trigger guard 16 or receiver 10 includes a viewing port 92 for viewing a portion of each of the dials 32.

Figure 8:
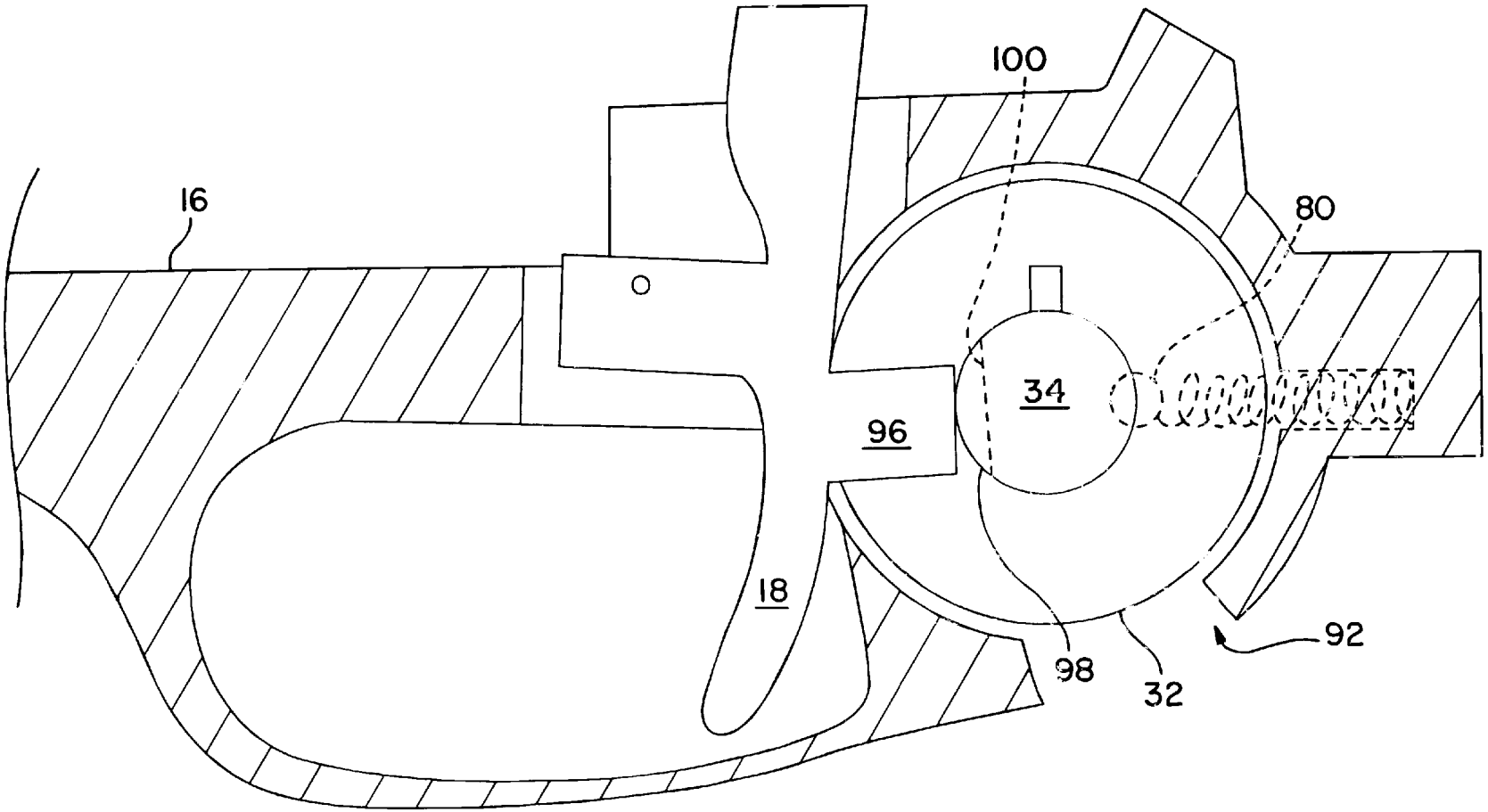
FIG. 8 is a side view, partly in section, of a portion of a trigger guard assembly incorporating one embodiment of an inventive safety.

The cross bolt 34 functions to prevent discharge of the firearm in the safe position while allowing discharge of the firearm in the fire position. For a hammer block-safety, the cross bolt 34 in the safe position is configured to block the hammer 22 or a component in the hammer assembly from striking the firing pin 24. For a trigger block-safety, the cross bolt 34 in the safe position is configured to interact with the trigger 18 or a component in the trigger assembly to prevent actuation of the trigger 18 and discharge of the firearm. In any embodiment, manual displacement of the cross bolt 34 to the fire position allows the firearm to be discharged by a user actuating the trigger 18. For example, as shown in FIG. 8 the trigger 18 may have a rearward shoulder or tab 96 which engages a shoulder surface 98 of the cross bolt 34 in the safe position and thereby prevents the trigger 18 from moving sufficiently to discharge the firearm. In the fire position, the tab 96 is free to pivot into a cross bolt clearance cutout 100 without restriction. The techniques and structures for accomplishing this bistable function are quite extensive and are not the specific subject of the invention.

When the dials 32 are rotated to the proper position, the connecting recesses 46 are rotationally and axially aligned with their respective pins 66 so that the cross bolt 34 may be axially displaced between the fire and safe positions solely by overcoming the resistance imposed by the detent 80 within the safe 76 or fire 78 recess. With the cross bolt 34 in the safe position, the dials 32 may be rotated so that at least one connecting recess 46 is out of rotational alignment with its respective pin 66. In this condition, the out of alignment pin 66 engages the respective inner face 44 so that axial displacement of the cross bolt 34 from the safe position to the fire position is prevented. Therefore, while a firearm employing an embodiment of the invention has conventional fire and safe positions, it also has a "locked safe" position where movement of the cross bolt 34 from the safe to the fire position is prevented until each of the combination dials 32 is placed in the rotationally correct position. Naturally, marking of the outside circumference 50 of each of the combination dials 32 with indicia 52 such as numbers provides a well-known "combination lock" type look and feel for the firearm safety 30. Adjustment of the angular relationship of the connecting recess 46 to the dial outer diameter indicia 52 allows changing the unlocking combination for individual firearms.

While the above embodiment provides a mechanism for locking the firearm safety 30 in the safe position to render the firearm unusable, when the cross bolt 34 is in the fire position the unlocking combination is susceptible to inspection. Described below are additional embodiments that are not as susceptible to inspection.

Figure 9:
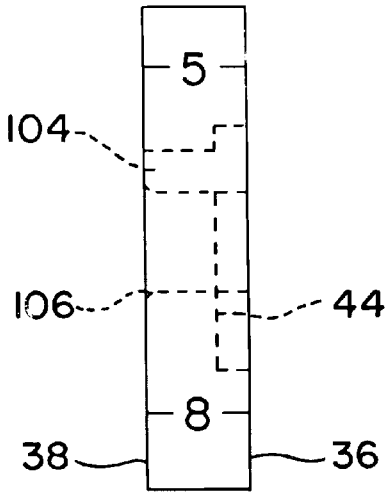
FIG. 9 is an edge view, partly in phantom, of a second embodiment of a combination dial.
Figure 10:
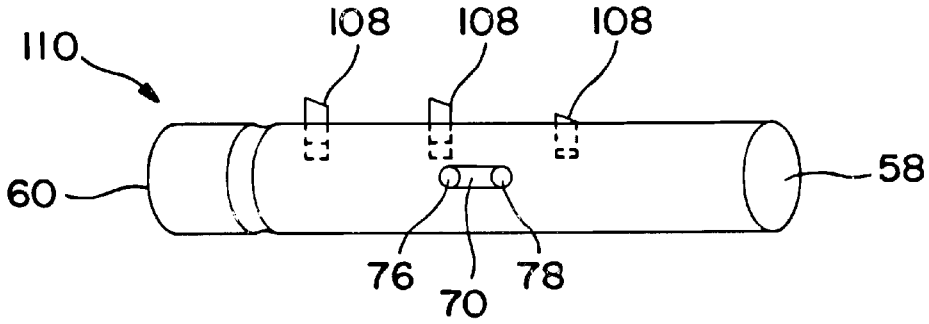
FIGS. 10 and 11 are perspective views of different embodiments of the cross bolt.

In a different embodiment shown in FIG. 9 the connecting recess 104 may be machined through the transverse width of the dial 32 so that it penetrates the dial second side 38. The rim 106 of the dial 32 through bore on the second side 38 is chamfered. As shown in FIG. 10, the pins 108 are mounted for radial displacement with relation to the cross bolt 110. Interference between the pins 108 and the dial inner faces 44 prevents displacement of the cross bolt 110 from the safe position unless each connecting recess 104 is rotationally aligned with its respective pin 108. Axial displacement of the cross bolt 110 from the safe position to the fire position moves the pins 108 through their respective rotationally and axially aligned connecting recesses 104 and beyond the second side 38. Engagement of the detent 80 within the cross bolt slot 70 prevents axial movement of the cross bolt 110 beyond the fire position. After the cross bolt 110 is placed in the fire position, the dials 32 may be rotated to obscure the unlocking combination. Manual displacement of the cross bolt 110 from the fire position to the safe position places the pins 108 in contact with the chamfered rim 106 of the dial through bore 40, forcing the pins 108 radially inward. Once the pins 108 have moved radially inward below the dial throughbore, the cross bolt 110 can be displaced to the safe position. Movement of the cross bolt 110 from the fire position to the safe position does not require alignment of the respective connecting recesses 46 and pins 108.

Figure 11:
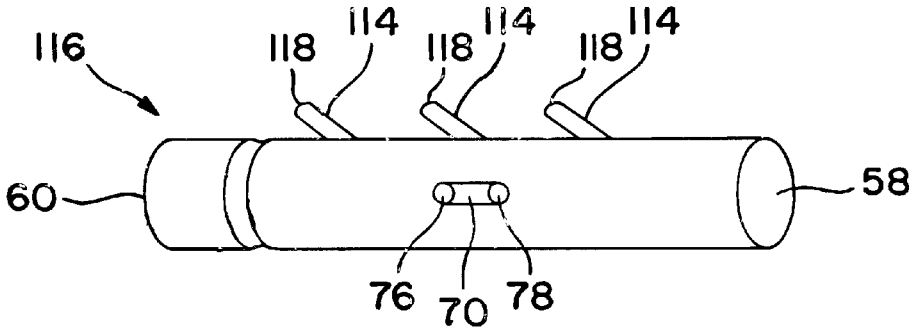

Alternatively, the pins 114 may project from the cross bolt 116 at an angle as shown in FIG. 11. The pin free ends 118 can be biased radially inward toward the cross bolt 116. Interference between the free ends 118 and the dial inner faces 44 prevents displacement of the cross bolt 116 from the safe position unless each connecting recess 104 is rotationally aligned with its respective pin 114. Manual displacement of the cross bolt 116 from the fire position to the safe position places the pins 114 in contact with the rim 106 of the dial through bore 40, forcing the pins 114 radially inward. Once the pins 114 have moved radially inwardly below the dial through bore, the cross bolt 116 can be displaced to the safe position. Movement of the cross bolt 116 from the fire position to the safe position does not require alignment of the respective connecting recesses 46 and pins 114.

While a preferred embodiment of the foregoing invention has been set forth for purposes of illustration, the foregoing description should not be deemed a limitation of the invention herein. Accordingly, various modifications, adaptations and alternatives may occur to one skilled in the art without departing from the spirit and the scope of the present invention.

What is claimed is:

1. In a firearm having a longitudinal axis, a safety assembly comprising:

recess means for defining a recess disposed generally transversely relative to said longitudinal axis;

a combination dial defining a central aperture and rotatably mounted within said recess; and a cross bolt mounted within said aperture, the cross bolt having opposing ends accessible to a user and being axially displaceable between a safe position and a fire position by manual manipulation of the ends, said cross bolt having axially spaced first and second surfaces respectively configured to prevent said firearm from discharging in said safe position and allowing said firearm to discharge in said fire position, said cross bolt cooperating with said dial so that said cross bolt is displaceable from the safe position to the fire position only when the dial is in a single rotational position, said dial comprises spaced first and second sides and defines a circular recess coaxial with said aperture and extending from said first side into said dial a first transverse distance to define a substantially circular inner face and a connecting recess radially extending from said aperture and transversely extending from said inner face toward said second face; and said cross bolt has a pin intermediate said ends, and said connecting recess cooperates with said pin at a single angular position to allow said cross bolt to be displaced from said safe position to said fire position, and said connecting recess defines a shoulder spaced from said inner face, said pin and said shoulder cooperating to prevent said pin from being displaced through said second side.

2. In a firearm having a longitudinal axis, a safety assembly comprising:

recess means for defining a recess disposed generally transversely relative to said longitudinal axis;

trigger means for discharging the firearm a combination dial defining a central aperture and rotatably mounted within said recess; and a cross bolt mounted within said aperture, the cross bolt having opposing ends accessible to a user and being axially displaceable between a safe position and a fire position by manual manipulation of the ends, said cross bolt is engageable intermediate the cross bolt ends with said trigger means in said safety position to prevent discharge of said firearm and allowing said firearm to discharge in said fire position, said cross bolt cooperating with said dial so that said cross bolt is displaceable from the safe position to the fire position only when the dial is in a single rotational position.

3. In a firearm having a longitudinal axis, a safety assembly comprising:

recess means for defining a recess disposed generally transversely relative to said longitudinal axis;

a combination dial defining a central aperture and rotatably mounted within said recess; and a cross bolt mounted within said aperture, the cross bolt having opposing ends accessible to a user and being axially displaceable between a safe position and a fire position by manual manipulation of the ends, said cross bolt having axially spaced first and second surfaces respectively configured to prevent said firearm from discharging in said safe position and allowing said firearm to discharge in said fire position, said cross bolt cooperating with said dial so that said cross bolt is displaceable from the safe position to the fire position only when the dial is in a single rotational position, and a detent biased into contact with said cross bolt to retain said cross bolt in semi-stable relationship in said safety and fire positions.

4. The safety assembly of claim 3, wherein said cross bolt has a projection intermediate said ends; and said aperture cooperates with said projection at a single rotational position to allow said cross bolt to be displaced from said safe position to said fire position.

5. The safety assembly of claim 3, wherein said dial defines a circular recess surrounding said aperture and a connecting recess connecting said aperture and said circular recess; said cross bolt has a projection intermediate said ends; and said connecting recess cooperates with said shoulder at a single rotational position to allow said cross bolt to be displaced from said safe position to said fire position.

6. The safety assembly of claim 3 further comprising at least one additional combination dial rotatably mounted within said recess, wherein said cross bolt cooperates with each said dial so that said cross bolt is displaceable from the safe position to the fire position only when the dial are each in a single, predetermined rotational position.

7. The firearm of claim 6, wherein:

each said dial comprises spaced first and second sides and defines a circular recess coaxial with said through bore and extending from first side transversely into said dial a first distance to define a substantially circular inner face and a connecting recess radially extending from said central through bore and transversely extending from said inner face toward said second side, said connecting recess defining a shoulder spaced from said inner face; and said cross bolt has a plurality of axially spaced pins intermediate said ends and an axially extending slot defining a first and a second recess, each said dial having only a singular angular position wherein a connecting recess can cooperate with a respective said pin to allow said cross bolt to be displaced from said safe position to said fire position, said connecting recess shoulder and said pin cooperating to prevent said pin from being displaced through said second side and said detent remaining engaged with said slot during axial displacement of said cross bolt to prevent rotation of said cross bolt.

8. The safety assembly of claim 3 wherein said firearm has a trigger guard comprising said recess means.

9. The firearm of claim 3, wherein said cross bolt includes an axially extending slot defining a first and a second recess and said detent remains engaged with said slot during axial displacement of said cross bolt to prevent rotation of said cross bolt.

10. The firearm of claim 3, wherein said trigger guard defines a recess and said plurality of combination dials are mounted in said recess.

11. The firearm of claim 3, wherein the cross bolt second axially spaced surface is a cutout defined in the cross bolt intermediate the cross bolt ends.

12. The safety assembly of claim 3 wherein the cross bolt first and second surfaces are intermediate the cross bolt ends.

13. In a firearm having a longitudinal axis, a safety assembly comprising:

a receiver defining a recess disposed generally transversely relative to said longitudinal axis;

a combination dial defining a central aperture and rotatably mounted within said recess; and a cross bolt mounted within said aperture, the cross bolt having opposing ends accessible to a user and being axially displaceable between a safe position and a fire position by manual manipulation of the ends, said cross bolt having axially spaced first and second surfaces respectively configured to prevent said firearm from discharging in said safe position and allowing said firearm to discharge in said fire position, said cross bolt cooperating with said dial so that said cross bolt is displaceable from the safe position to the fire position only when the dial is in a single rotational position.

* * * * *

UNITED STATES PATENT AND TRADEMARK OFFICE

CERTIFICATE OF CORRECTION

PATENT NO. : 6,519,888 B1
DATED : February 18, 2003
INVENTOR(S) : Oberst

It is certified that error appears in the above-identified patent and that said Letters Patent is hereby corrected as shown below:

Column 8,
Line 37, delete “claim 3” and insert -- claim 6 --.

Signed and Sealed this

Twenty-second Day of June, 2004

JON W. DUDAS
*Acting Director of the United States Patent and Trademark Office*